United States Patent [19]

Smallwood

[11] 4,402,092

[45] Sep. 6, 1983

[54] SPRING MECHANISM FOR TOILET SEATS

[76] Inventor: Larry L. Smallwood, 1240 South 16th St., Grover City, Calif. 93449

[21] Appl. No.: 307,846

[22] Filed: Oct. 2, 1981

[51] Int. Cl.[3] ..... A47K 13/12

[52] U.S. Cl. ..... 4/240; 4/236

[58] Field of Search ..... 4/240, 241, 242, 251, 4/237, 234, 236

[56] References Cited

U.S. PATENT DOCUMENTS

| | | | |
|---|---|---|---|
| 566,621 | 8/1896 | Rider et al. | 4/241 X |
| 900,514 | 10/1908 | Geary | 4/241 |
| 1,529,656 | 3/1925 | Kornhauser | 4/241 X |
| 2,074,318 | 3/1937 | Bachmann | 4/241 X |
| 2,164,116 | 6/1939 | Lincoln | 4/241 |
| 2,305,147 | 12/1942 | Deal | 4/241 |
| 2,812,522 | 11/1957 | Wilson | 4/241 |
| 2,814,049 | 11/1957 | Mercur | 4/251 X |
| 2,877,469 | 3/1959 | Johnson | 4/241 |
| 4,195,372 | 4/1980 | Farina | 4/251 |

FOREIGN PATENT DOCUMENTS

| | | | |
|---|---|---|---|
| 1001099 | 2/1952 | France | 4/241 |

*Primary Examiner*—Henry K. Artis

*Attorney, Agent, or Firm*—Harry W. Brelsford

[57] ABSTRACT

A hinged toilet seat that is spring-biased to either an upright or a horizontal position is slowed in its angular rotation to the spring-biased position. The user manually pushes the toilet seat to its use position and after use the toilet seat returns to its spring-biased position. This angular rotation is slowed by the present mechanism wherein the seat is attached to a hinge shaft which has a large gear engaging a small gear on an idler shaft. The rotation of the idler shaft is braked by a slipping clutch, which thereby slows the angular motion of the toilet seat to its spring-biased position.

3 Claims, 4 Drawing Figures

SPRING MECHANISM FOR TOILET SEATS

TECHNICAL FIELD

My invention relates to a controlled spring mechanism whereby toilet seats are raised to an upright position or alternatively lowered to a horizontal position at a controlled rate of angular velocity. The rate of angular movement is adjustable.

BACKGROUND ART

In public toilets it is desirable to maintain the toilet seat in a vertical or upright position when it is not in use. The user may manually pull the seat to a horizontal position. In private homes it is desirable for aesthetic reasons to have the toilet seat in a horizontal position, and a person desiring to urinate normally lifts the seat to an upright position before urinating. The prior art, U.S. Pat. No. 4,195,372, shows a spring for returning a seat to the desired position: upright for public toilets and horizontal for private toilets.

These spring-biased seats, however, present a hazard to users in that they must be held by the user to a desired position and when the user releases the seat it snaps to a vertical position in public toilets and to a horizontal position for private toilets. This fast-moving toilet seat may strike the user or at least be uncomfortable or inconvenient.

DISCLOSURE OF THE INVENTION

I provide a mechanism for slowing up the angular movement of spring-biased toilet seats so that the user is not physically struck by the seat when he releases the seat. Furthermore, the rate of angular movement may be adjusted.

I provide an idler shaft driven by a gear attached to a shaft rotated by the toilet seat. I provide a slipping clutch for this idler shaft so that it rotates at a desired rate of speed when a spring returns the seat to the desired position. The relatively moving parts of the clutch are adjustable to give any desired rate of rotation to the idler shaft and thereby any desired rate of angular movement to the toilet seat.

DETAILED DESCRIPTION

The drawings form an integral part of this specification and

Figure 1:
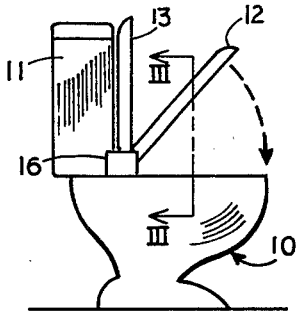
FIG. 1 is an elevation view of a toilet bowl and a tank in a private toilet wherein a spring urges the toilet seat to a horizontal position and the rate of movement pursuant to the spring is regulated by the mechanism of the invention.

Referring to FIG. 1 there is illustrated a toilet bowl 10 having a water tank 11 and having a toilet seat 12 and a toilet seat cover 13. The toilet seat 12 is normally maintained in a horizontal position for aesthetic reasons in private toilets. The toilet seat 12 is urged to a horizontal position by a spring mechanism in accordance with the invention designated generally by the numeral 16.

Figure 2:
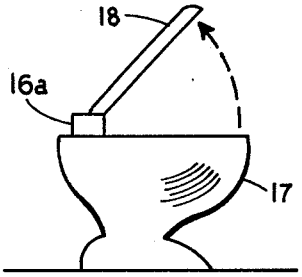
FIG. 2 is an elevation view of a toilet bowl in a public toilet wherein the seat is urged to a vertical position by a spring and the rate of movement is controlled by the invention.

Referring to FIG. 2 there is illustrated a toilet bowl 17 having a toilet seat 18 urged to a vertical or upright position by means of the mechanism **16*a* provided in accordance with the invention. The structure for lifting the seat 18, FIG. 2, would be used in public toilets where it is desirable to have the seat maintained in an upright position when not in use. Both the seat 12 of FIG. 1 and the seat 18** may be identical in structure and are the usual oval with a hole in the middle upon which a person seats himself to use the toilet.

Figure 3:
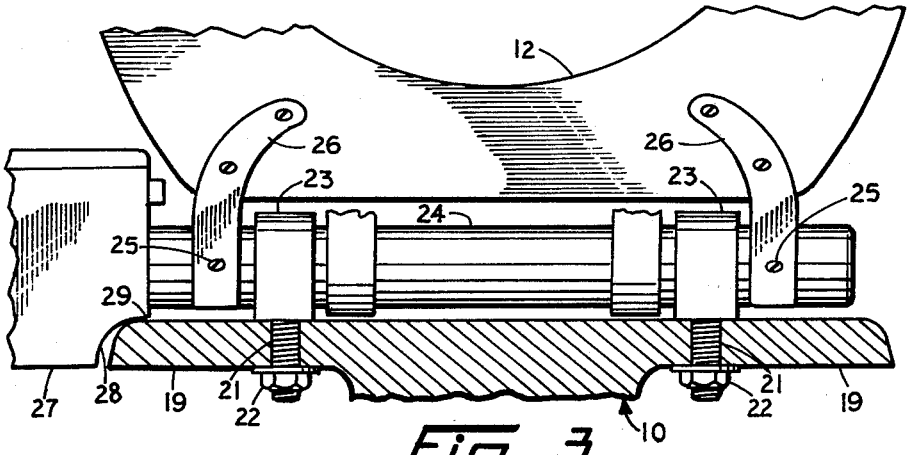
FIG. 3 is an elevation view taken along the line of III—III of FIG. 1 on an enlarged scale.

Referring to FIG. 3 there is illustrated a portion of the toilet bowl 10 having an outwardly extending flange 19 through which are formed a pair of holes 21 through which pass bolts 22. The upper ends of the bolts are secured to a ring shaped bearing 23 and these two bearings 23 support a rotatable shaft 24 provided particularly in accordance with the invention.

Rigidly secured to the shaft 24 are a pair of straps 26 which support the toilet seat 12 rigidly on the shaft 24. When the seat is moved from a horizontal to a vertical position and vice versa the shaft 24 is rotated by this movement of seat 12. The left end of the shaft 24 passes into a control box 27 provided particularly in accordance with the invention.

Figure 4:
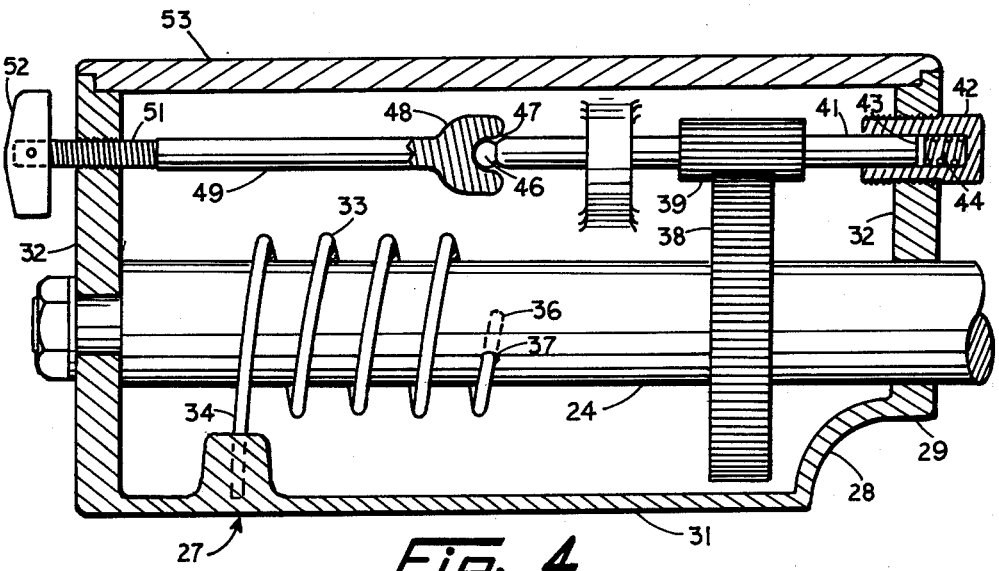
FIG. 4 is an elevation view partly in section through the control mechanism and the spring for returning the toilet seat to a desired position whether up or down.

Referring now to FIGS. 3 and 4, the control box 27 has on its lower right-hand corner a curved cutout 28 which enables the upper edge of the cutout at 29 to bear against the upper surface of the left-hand part of the flange 19. This bearing on the toilet bowl flange 19 provides one point of attachment of the spring to turn the toilet seat 12 either up or down depending whether it is in a public or private toilet.

Referring to FIG. 4 the housing 27 may have a bottom plate 31 and end walls 32. The shaft 24 passes through both end walls and a bearing is formed between the housing 27 and the shaft at these end walls 32. Wrapped around the shaft 24 is a helical spring 33 having one end tangential at 34 to project through a hole in the bottom of the housing 27. The other end of the spring terminates in a radially inwardly projecting portion 36 which is held in a bore 37 in the shaft 24. In this fashion torque is transmitted to the shaft 24 from the housing 27, and because of the bearing of housing 27 on the ball flange 19 this torque is developed between the toilet bowl 10 and the shaft 24.

Referring still to FIG. 4 there is provided particularly in accordance with the invention a spur gear 38 rigidly secured to the shaft 24 and this meshes with a smaller pinion gear 39 disposed on an idler shaft 41 having its right end in a bearing block 42 also containing a washer 43 and a compression spring 44, which urges the shaft 41 to the left. The left end of idler shaft 41 terminates in a ball 46 rotating within a stationary socket 47. This ball and socket construction forms a slipping clutch. The socket 47 is formed on an enlargement 48 on the right-hand end of a stationary cantilever support rod 49 thread at 51 into the left-hand end wall 32. The projecting threaded end 51 has secured to it a wing bolt head 52, which can be manually rotated to move the cantilever support shaft 49 either inwardly or outwardly with respect to the housing 27. The housing 27 may be capped off by a top plate 53.

OPERATION

The operation of the device will be explained with respect to FIGS. 3 and 4. The parts have been assembled shown in FIG. 4 the toilet seat 12 is secured to the shaft 24 after the shaft has been rotated in the appropriate direction to cause a torque to be developed by the spring 33, according to the desired direction that the seat 12 is to move under the influence of the spring. The straps 26 are then secured to the shaft 24 by any appropriate mechanism such as bolts or screws 25. This spring 33 thereupon rotates the seat to the desired direction either upright or horizontal. If the seat is horizontal, as in a private home, the user desiring to urinate lifts the seat manually causing the shaft 24 to rotate. This rotates the spur gear 38 which in turn rotates the spur gear 39 on the ilder shaft 41, but the friction at the slipping clutch 46–47 is such that there is little impediment to manual lifting of the seat about the axis of the shaft 24. When the user releases this manual grip on the upper edge of the toilet seat 12, the spring 33 thereupon causes the shaft 24 and the seat 12 to rotate to the horizontal position. This however is a gradual movement because of the fact that the slipping clutch 46–47 exerts a restraining rotational force on the idler shaft 41, thereby slowing the rotation of the shaft 24 because of the leverage distance represented by the relative diameters of gears 38 and 39.

The speed of rotation of idler shaft 41 under the influence of spring 33, is regulated by rotating the thumbnut or wing bolt heat 52 to move the shaft 49 to the right or to the left. When the shaft 49 moves to the right as it is rotated, the shaft impinges upon the compression spring 44 in the righthand bearing block 42. This increased amount of pressure creates a higher slipping torque for the clutch 46–47 thus slowing up the rotation of the shaft 41 and consequently the shaft 24. Rotation of the bolt head 52 in the opposite direction to move the shaft 49 to the left relaxes the compression on the clutch 46–47 so that a faster amount of rotation of the idler shaft 41 is achieved with a consequent faster rotation of the toilet seat shaft or pivot shaft 24.

I have described my invention with respect to a presently preferred embodiment as required by the Statutes. This embodiment is illustrative, however, as various modifications will occur to those skilled in the art. All such modifications and variations that come within the true spirit and scope of the invention are included within the terms of the following claims.

I claim:

1. A spring mechanism for returning a toilet seat to a desired angular position relative to a toilet bowl comprising:

(a) a rotatable pivot shaft mounted on the toilet bowl and to which the toilet seat is secured so that the shaft is rotated whenever the toilet seat is rotated over its angular travel;

(b) a spring interconnecting the toilet bowl and the pivot shaft and biased to yieldably hold the toilet seat in a desired position;

(c) a gear secured to the pivot shaft;

(d) an idler shaft;

(e) a gear secured to the idler shaft engaging the gear on the pivot shaft;

(f) and a slipping clutch connected to the idler shaft and connected to the toilet bowl to regulate the speed of rotation of the idler shaft as it is rotated by the spring acting on the pivot shaft, said slipping clutch permitting slippage when the toilet seat is manually rotated on the pivot shaft.

2. A spring mechanism as set forth in claim 1 wherein the clutch slippage is adjustable.

3. A spring mechanism as set forth in claim 1 wherein the clutch the has at least two slipping surfaces, and manually operated means for varying the pressure on the two slipping surfaces of the slipping clutch.

* * * * *